United States Patent [19]

Darvin

[11] Patent Number: 5,066,851

[45] Date of Patent: Nov. 19, 1991

[54] FORCED CONVECTION OVEN

[75] Inventor: Richard M. Darvin, Richardson, Tex.

[73] Assignee: QNC, Inc., Dallas, Tex.

[21] Appl. No.: 557,141

[22] Filed: Jul. 23, 1990

Related U.S. Application Data

[63] Continuation-in-part of Ser. No. 422,233, Oct. 2, 1989, Pat. No.

[51] Int. Cl.[5] ..... A21B 1/26; A21B 1/22; F24C 15/32

[52] U.S. Cl. ..... 219/400; 219/391; 126/21 A; 126/21 R

[58] Field of Search ..... 219/400, 391; 126/21 A, 126/21 R

[56] References Cited

U.S. PATENT DOCUMENTS

| | | | |
|---|---|---|---|
| 3,759,241 | 9/1973 | Berkhoudt | 219/400 |
| 4,051,347 | 9/1977 | Röhrl et al. | 219/400 |
| 4,824,644 | 4/1989 | Cox et al. | 216/21 A |
| 4,829,158 | 5/1989 | Burnham | 219/400 |

FOREIGN PATENT DOCUMENTS

| | | | |
|---|---|---|---|
| 57-131939 | 8/1982 | Japan | 219/400 |

*Primary Examiner*—Teresa J. Walberg
*Assistant Examiner*—Tuan Vinh To
*Attorney, Agent, or Firm*—Richards, Medlock & Andrews

[57] ABSTRACT

A forced convection cooking apparatus having an enclosed cooking chamber within a housing and a resistance heater suspended in the upper portion thereof provides radiant and convection heating to cook food. The food is contained in a cooking tray which has a screen bottom to allow grease, oils and the like to drip through the cooking tray. A drip tray below the cooking tray catches liquids which drip through the cooking tray. A baffle is located in the cooking chamber near the back of the chamber. A fan draws air through a hole in the baffle and forces the air around the curved sides of the baffle toward the front of the cooking chamber.

6 Claims, 2 Drawing Sheets

FORCED CONVECTION OVEN

FIELD OF THE INVENTION

This application is a continuation-in-part of application Ser. No. 07/422,233, filed Oct. 2, 1989, now abandoned.

This invention relates to apparatus for rapidly cooking food products. More particularly, it relates to ovens for quickly cooling food products by radiant and convection heating.

BACKGROUND OF THE INVENTION

Proprietors of fast food restaurants are always searching for ways to cook food faster, cleaner and less expensively. Many fast food restaurants serve french fried potatoes so apparatus is needed to cook the french fries quickly, cleanly and inexpensively.

The most common method of cooking french fries is deep frying in hot fat or oil. The potatoes are placed in a basket which is lowered into the hot fat or oil. Deep fat frying takes a relatively long time and is relatively dangerous. The hot fat or oil is a potential fire hazard and dangerous to personnel. A deep fat fryer will therefore generally increase the insurance premiums of a restaurant.

Forced convection ovens are generally safer than deep fryers for cooking french fries and similar food products. Forced convection ovens blow hot air over the food until the food is sufficiently cooked, but it is difficult for the air to heat the food product sufficiently to evenly cook the food in a short time. Another problem associated with forced convection ovens is how to direct the stream of air to insure that the food is cooked uniformly. In some ovens the food is placed in a cage which is rotated in a stream of air. However, such ovens are unsuitable for food products such as pizzas or sandwiches which may be destroyed by the tumbling action.

In U.S. Pat. No. 4,503,760 issued Mar. 12, 1985 to Pryputsch, et al. a drum rotates around the food. The forced hot air blows against the food product through a hole in the drum. As the hole in the drum rotates around the food products the air blows against the food product from different angles.

SUMMARY OF THE INVENTION

The forced convection oven of the present invention provides fast, easy and safe apparatus for preparing food products. The apparatus includes a cooking chamber within a housing. A resistance heater is mounted in the upper portion of the heating chamber and a cooking tray supports the food products in the cooking chamber.

A fan and a specially designed baffle force hot air over the food products to increase cooking efficiency and to decrease the time required to cook the food. The baffle is a generally vertical sheet mounted near the rear of the cooking chamber. The fan draws air away from the food products through a hole in the baffle. The air is then forced by the fan to flow around the edges of the baffle. The edges of the baffle are curved to facilitate the air flow.

The tray on which the food products are supported is an open screen so that grease, oils and the like can fall through the tray and air can flow through the tray. A drip tray is mounted below the cooking tray to catch any liquids which drip through the cooking tray. Both the cooking tray and the drip tray can be easily removed from the front of the housing. Other features and advantages of the invention will become more readily understood from the following detailed description taken in connection with the appended claims and attached drawing in which:

DETAILED DESCRIPTION

Figure 1:
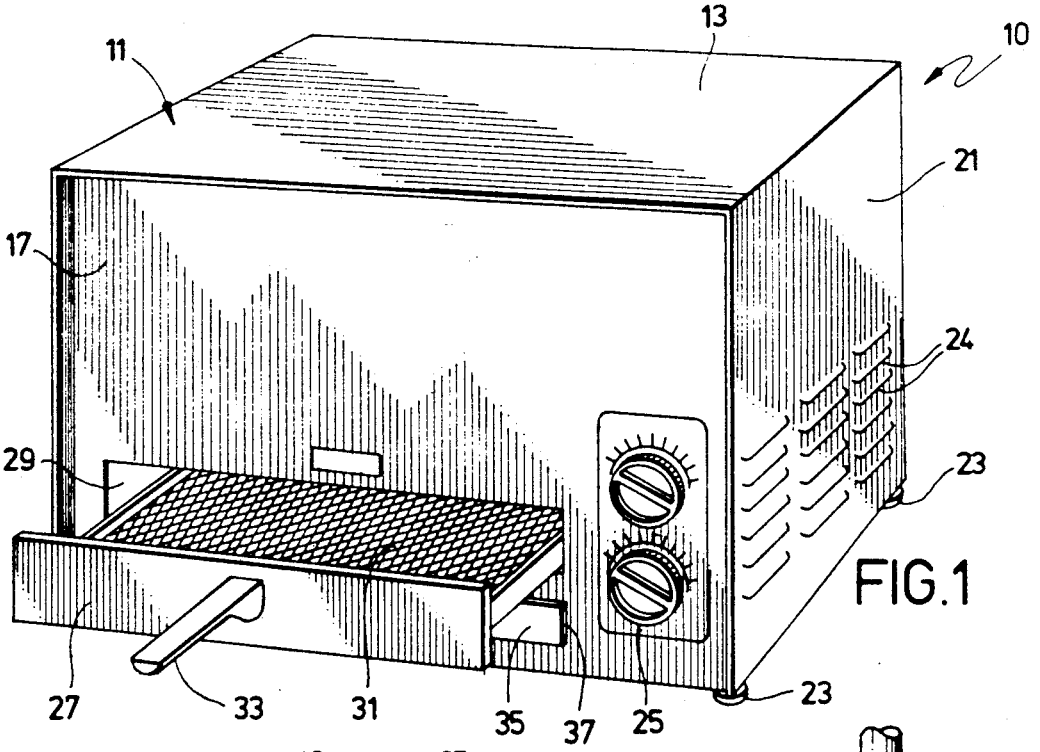
FIG. 1 is a perspective view of the preferred embodiment of the invention.
Figure 2:
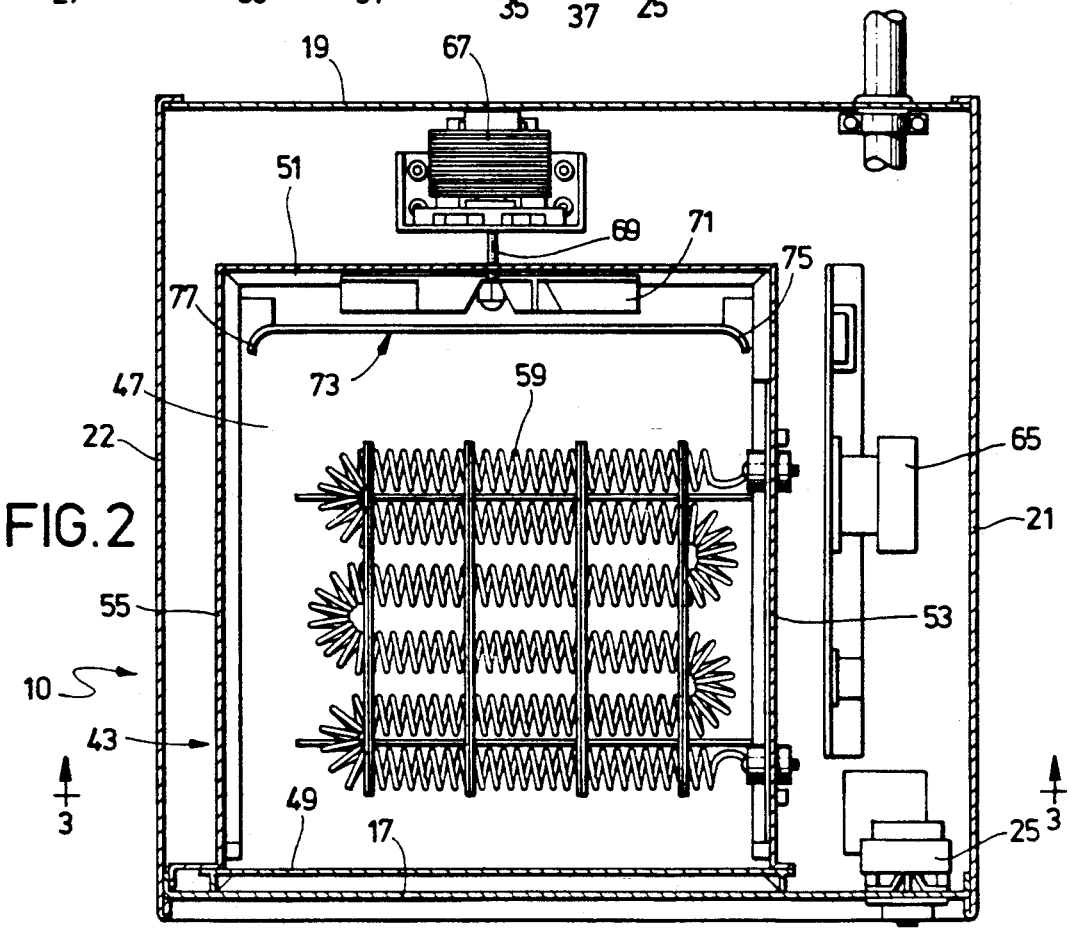
FIG. 2 is a sectional view of the apparatus of FIG. 1 taken through line 2—2 of FIG. 4.
Figure 3:
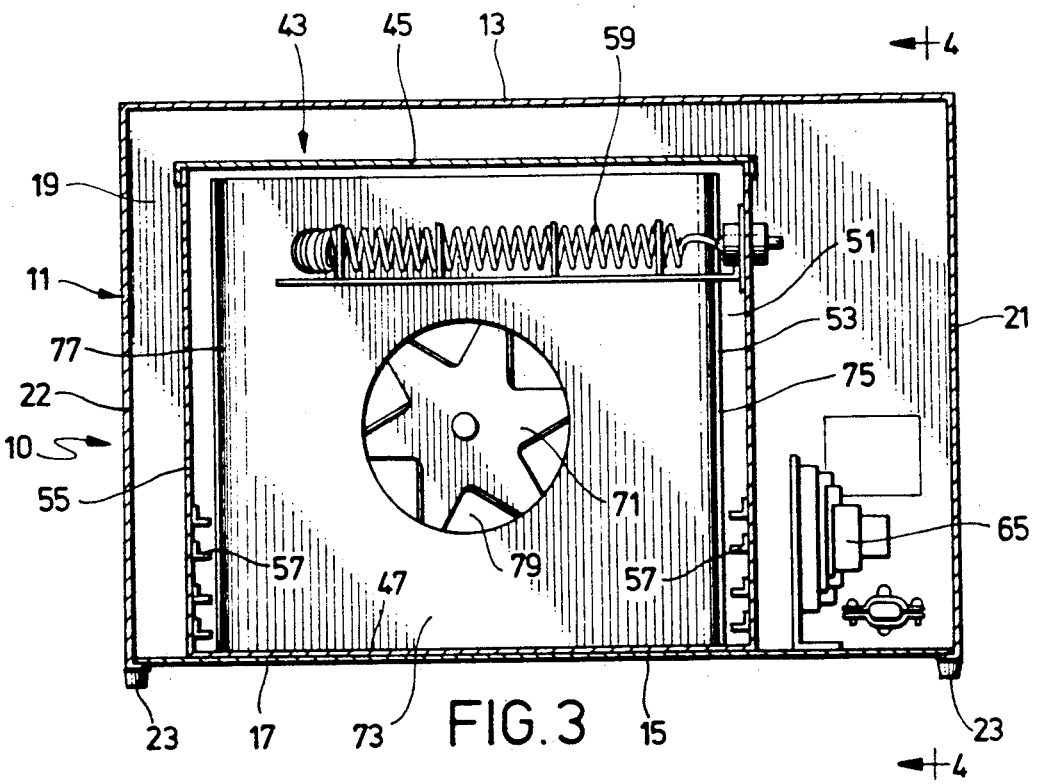
FIG. 3 is a sectional view of the apparatus of FIG. 1 taken through line 3—3 of FIG. 2.
Figure 4:
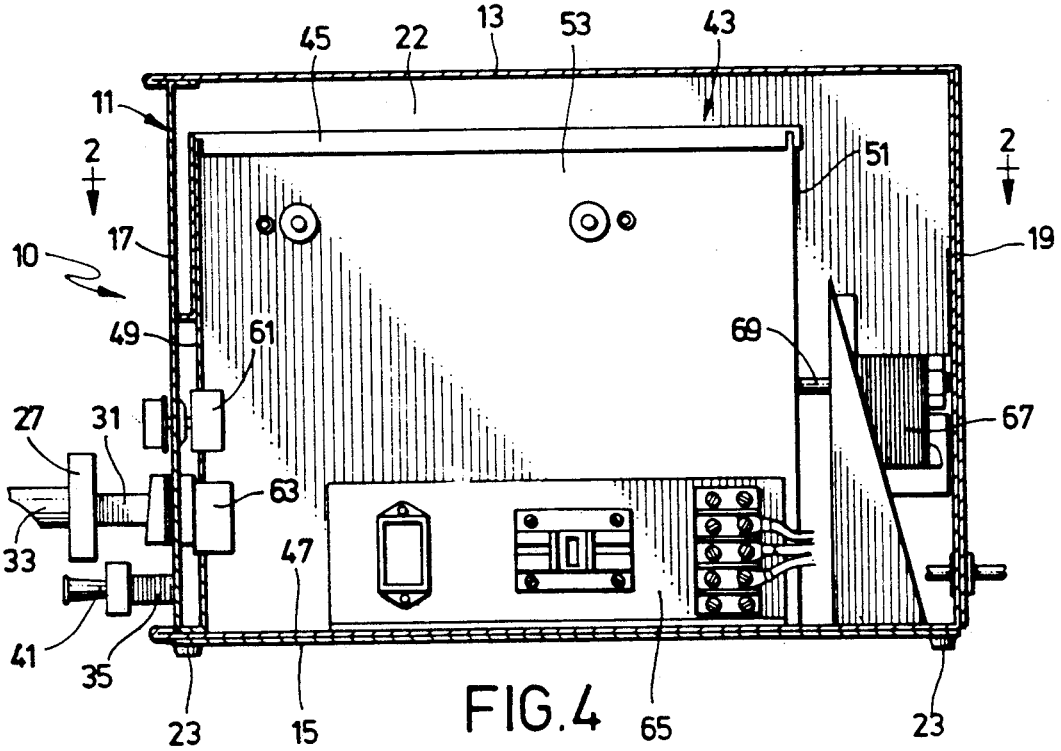
FIG. 4 is a sectional view of the apparatus of FIG. 1 taken through line 4—4 of FIG. 3.

As shown in the drawing the preferred embodiment of the invention is an oven 10 having a housing 11. The housing 11 has a top 13, a bottom 15, a front 17, a back 19, a right side 21 and a left side 22. The housing 11 is supported by four feet 23 mounted at the corners of the bottom 15 of the housing 11. A plurality of vents 24 in the right side 21 of the housing 11 provide ventilation for the electrical components within the housing 11. The controls 25 for the oven 10 are conveniently located on the front 17 of the housing 11.

A cooking tray 27 is inserted into a slot 29 in the front 17 of the housing 11. The cooking tray 27 has a screen bottom 31 so that grease, oils and the like can drip through the bottom 31 of the tray 27. Air can flow easily through the screen bottom 31 of the tray 27. The screen bottom 31 of the tray 27 will support a quantity of french fries or other food products to be cooked.

A handle 33 on the front of the cooking tray 27 facilitates handling of the cooking tray 27. The cooking tray 27 can be quickly and easily removed from the housing 11 in order to remove the cooked food. The cooking tray 27 can then be refilled with food products and reinserted into the housing 11.

Immediately below the cooking tray 27, a drip tray 35 is inserted into another slot 37. The drip tray 35 has a solid bottom 39 designed to catch any liquids which drip from the food product through the cooking tray 27. A handle 41 on the drip tray 35 facilitates handling of the drip tray 35. The drip tray 35 can be removed from the housing 11 when full and thus provides an easy method of disposing of grease, oils and the like removed from the food products.

A cooking chamber 43 is formed within the housing 11 by a top 45, a bottom 47, a front 49, a back 51, a right side 53 and a left side 55. Several pairs of shelves 57 provide support for the cooking tray 27 and the drip tray 35 at selected heights within the cooking chamber 43.

If desired, the cooking tray 27 and the drip tray 35 can be an integral unit insertable through a single slot 29. In this case the slot 29 may be larger and the front face of the cooking tray 27 must be large enough to completely cover the slot 29 to prevent entry or escape of air through slot 29 when the tray is in the cooking position. Similarly, the drip tray 35 may rest on the bottom floor of the cooking chamber 43 and be individually removable through the slot 29 as desired after the cooking tray 27 has been removed. Various other arrangements of the cooking tray 27 and drip tray 35 may be used so long as the cooking tray is suspended within the cooking chamber so that air may contact the contents of the cooking tray from all sides, liquids may drip from the cooking tray into the drip tray, and the cooking tray can be removed from the front slot 29 but maintains the front slot 29 closed to the entry or escape of air during the cooking process.

A resistance heater 59 is suspended in the upper portion of the cooking chamber 43. The resistance heater 59 provides direct radiant heating of food products carried on the cooking tray 27.

Cooking parameters are set by the controls 25 on the front 17 of the housing 11. The temperature in the cooking chamber 43 is controlled by a thermostat 61 which is mounted on the front 17 of the housing 11. Timing of the cooking cycle is controlled by a timer 63 also mounted on the front 17 of the housing 11. Other electrical components 65 required by the apparatus are located between the right side 21 of the housing 11 and the right side 53 of the cooking chamber 43.

An electric motor 67 is mounted in the rear of the housing 11 between the back 19 of the housing 11 and the back 51 of the cooking chamber 43. The motor 67 rotates a shaft 69 which extends through the back 51 of the cooking chamber 43 into the cooking chamber 43. A fan 71 is attached to the end of the shaft 69 so that the fan 71 is located in the rear portion of the cooking chamber 43. Directly in front of the fan 71 is a baffle 73 which is a generally vertical sheet. The baffle 73 extends from the bottom 47 of the cooking chamber 43 to near the top 45. However, the sides 75 and 77 of the baffle 73 do not reach the sides 53 and 55 of the cooking chamber 43. Therefore, the fan 71 can blow air around the sides 75 and 77 of the baffle 73. The sides 75 and 77 of the baffle 73 are curved toward the front 49 of the cooking chamber to facilitate the flow of air around the sides 75 and 77 of the baffle 73.

The baffle 73 also has a circular hole 79 directly in front of the fan 71. The fan 71 draws air through the hole 79 toward the back 51 of the cooking chamber 43. The air then flows around the sides 75 and 77 of the baffle 73 toward the front 49 of the cooking chamber 43. Hot air is thus forced to blow across the food in the cooking tray 27 to cook the food by forced convection. The food is also cooked by radiant heat from the heater 59. The combination of forced convection and radiant heating provides very fast and uniform cooking of food products.

It should be noted that the air contained within the cooking chamber 43 is heated and recirculated. Additional outside air is not needed and essentially no heated air is exhausted. Furthermore, since the air is recirculated over the exposed heating elements, foreign matter such as smoke and the like are exposed to the heating elements and oxidized. Thus smoke and the like are consumed within the chamber without need for venting, etc. Furthermore, recirculation of air conserves heat energy and promotes rapid increase of the air temperature to the temperatures necessary for causing quick and sustained high temperature cooking of the product contained in the oven. The apparatus of the invention thus provides quick, easy and clean cooking of fried food products. The device is easy and quick to load and unload and the cooking cycles are very short. The drip tray 35 also provides an easy way to dispose of grease, oils and the like which are removed from the food products during cooking.

It will be appreciated that the foregoing detailed description is presented by way of example only. Various modifications and changes may be made thereto without departing from the spirit and scope of the invention as defined by the appended claims.

What is claimed:

1. Forced convection cooking apparatus comprising:

a housing defining an enclosed cooking chamber which substantially prevents entrance or escape of air;

a resistance heater suspended in the upper portion of the cooking chamber;

a first opening in the front face of said cooking chamber adapted to receive a cooking tray;

a cooking tray positioned near the bottom of the cooking chamber for supporting food to be cooked and adapted to permit liquids to drip therethrough and air to flow therethrough, said cooking tray removably fitting within said first opening to prevent the flow of air through said first opening;

a handle on the front of the cooking tray for facilitating removal and insertion of the cooking tray from said first opening;

a second opening in said front face adapted to receive and support a drip tray below said cooking tray;

a drip tray removably fitting within said second opening to prevent the flow of air through said second opening and positioned below said cooking tray to receive liquids dripping from said cooking tray;

a handle on the front of said drip tray for facilitating removal and insertion of the drip tray from said second opening;

a vertical baffle positioned near the rear of the cooking chamber and having a hole wherein air can flow through the hole and around the sides of the vertical baffle; and a fan for drawing air through the hole toward the rear of the cooking chamber and for forcing air around the sides of the baffle toward the front of the cooking chamber.

2. Forced convection cooking apparatus as defined in claim 1 wherein the sides of the baffle are curved to assist the flow of air around the sides of the baffle.

3. Forced convection cooking apparatus as defined in claim 2 wherein the sides of the baffle are curved toward the front of the cooking chamber to assist the flow of air around the sides of the baffle.

4. Forced convection cooking apparatus comprising:

a housing defining an enclosed cooking chamber which substantially prevents entrance or escape of air;

a resistance heater suspended in the upper portion of the cooking chamber;

an opening in the front face of said cooking chamber adapted to receive a cooling tray;

a cooking tray positioned within the cooking chamber for supporting food to be cooked and adapted to permit liquids to drip therethrough and air to flow therethrough, said cooking tray removably fitting within said opening to prevent the flow of air through said opening;

a handle on the front of the cooking tray for facilitating removal and insertion of the cooking tray from said opening;

a drip tray removably positioned below said cooking tray to receive liquids dripping from said cooking tray;

a vertical baffle positioned near the rear of the cooking chamber and having a hole wherein air can flow through the hole and around the sides of the vertical baffle; and a fan for drawing air through the hole toward the rear of the cooking chamber and for forcing air around the sides of the baffle toward the front of the cooking chamber.

5. Forced convection cooking apparatus as defined in claim 4 wherein the sides of the baffle are curved to assist the flow of air around the sides of the baffle.

6. Forced convection cooking apparatus as defined in claim 5 wherein the sides of the baffle are curved toward the front of the cooking chamber to assist the flow of air around the sides of the baffle.

* * * * *

UNITED STATES PATENT AND TRADEMARK OFFICE

CERTIFICATE OF CORRECTION

PATENT NO. : 5,066,851

DATED : November 19, 1991

INVENTOR(S) : Richard M. Darvin

It is certified that error appears in the above-identified patent and that said Letters Patent is hereby corrected as shown below:

Column 1, line 10, change "cooling" to --cooking--

Column 1, line 56, clarify the blurred word to read --food.--

Column 3, line 56, clarify the blurred word to read --conserves--

Column 4, line 54, change "cooling" to --cooking--

Signed and Sealed this

Ninth Day of March, 1993

*Attest:*

STEPHEN G. KUNIN

*Attesting Officer*

*Acting Commissioner of Patents and Trademarks*